US010849372B2

(12) United States Patent
Hartman et al.

(10) Patent No.: US 10,849,372 B2
(45) Date of Patent: Dec. 1, 2020

(54) WEARABLE RAIN COVER SYSTEM AND METHOD OF USE

(71) Applicants: Konner Hartman, Cedar Hill, TX (US); Michael Benavidez, Cedar Hill, TX (US)

(72) Inventors: Konner Hartman, Cedar Hill, TX (US); Michael Benavidez, Cedar Hill, TX (US)

( * ) Notice: Subject to any disclaimer, the term of this patent is extended or adjusted under 35 U.S.C. 154(b) by 88 days.

(21) Appl. No.: 16/100,972

(22) Filed: Aug. 10, 2018

(65) Prior Publication Data

US 2019/0045854 A1 Feb. 14, 2019

Related U.S. Application Data

(60) Provisional application No. 62/543,732, filed on Aug. 10, 2017.

(51) Int. Cl.

| | |
|---|---|
| ***A41D 3/00*** | (2006.01) |
| ***A41D 3/04*** | (2006.01) |
| ***A45F 3/04*** | (2006.01) |
| ***A41D 15/04*** | (2006.01) |
| ***A45F 4/00*** | (2006.01) |
| *A45F 3/00* | (2006.01) |

(52) U.S. Cl.

CPC ..... *A41D 3/04* (2013.01); *A41D 15/04* (2013.01); *A45F 3/04* (2013.01); *A45F 4/00* (2013.01); *A41D 2400/48* (2013.01); *A45F 2003/001* (2013.01)

(58) Field of Classification Search

CPC ..... A41D 3/04; A41D 15/04; A41D 2400/48; A45F 4/00; A45F 3/04; A45F 2003/001

See application file for complete search history.

(56) References Cited

U.S. PATENT DOCUMENTS 2,165,348 A * 7/1939 Daiber ..... A41D 15/04 2/94
3,950,789 A * 4/1976 Konz ..... A41D 13/0055 2/93
4,502,155 A * 3/1985 Itoi ..... A41D 3/00 2/115
4,689,831 A * 9/1987 Greenberger ..... A45F 4/12 2/108
5,123,117 A * 6/1992 Prendergast ..... A45F 4/12 2/108
5,526,969 A * 6/1996 Greenberger ..... A41D 15/04 2/69.5
5,699,560 A * 12/1997 Greenberg ..... A41D 3/00 2/94
5,850,634 A * 12/1998 Toombs ..... A41D 15/04 2/93

(Continued)

*Primary Examiner* — Khaled Annis

(57) ABSTRACT

A rain cover system includes a jacket composed of a rain resistant material to be worn by a user, the jacket having a compartment accessible from a back portion of the jacket via a closure mechanism; and a pack cover disposed within the compartment to extend away from the back portion of the jacket; the pack cover is configured to enclose a backpack to protect against rain; the pack cover is integral with the jacket, thereby providing zero access points for water to reach the backpack; and the pack cover is stored flat against the user's back within the compartment when not in use.

8 Claims, 5 Drawing Sheets

(56) References Cited

U.S. PATENT DOCUMENTS

| | | | | |
|---|---|---|---|---|
| 6,073,268 | A * | 6/2000 | Ziegler | A41D 3/00 2/108 |
| 6,405,377 | B1 * | 6/2002 | Davis | A41D 15/04 2/108 |
| 7,363,659 | B1 * | 4/2008 | Colbert | A41D 3/00 2/86 |
| D769,580 | S * | 10/2016 | Conway | D2/830 |
| 2003/0033658 | A1 * | 2/2003 | Hinnant | A41D 3/02 2/93 |
| 2006/0000004 | A1 * | 1/2006 | Elen | A41D 3/00 2/108 |
| 2007/0141940 | A1 * | 6/2007 | Baychar | A41D 31/02 442/328 |
| 2008/0120769 | A1 * | 5/2008 | Gollin | A41D 3/00 2/467 |
| 2009/0205102 | A1 * | 8/2009 | Anderson | A41D 3/00 2/85 |
| 2010/0320241 | A1 * | 12/2010 | Thompson | A41D 15/04 224/153 |
| 2011/0099682 | A1 * | 5/2011 | Earley | A41D 13/0012 2/115 |
| 2011/0233242 | A1 * | 9/2011 | Broudy | A41D 13/0012 224/230 |
| 2013/0047312 | A1 * | 2/2013 | Wilson | A45F 5/02 2/69 |
| 2013/0313299 | A1 * | 11/2013 | Igwenagu | A45F 3/00 224/576 |
| 2016/0374458 | A1 * | 12/2016 | Jansen | A45F 3/04 224/576 |
| 2017/0066583 | A1 * | 3/2017 | Kimbrough | A41D 13/0056 |
| 2017/0347722 | A1 * | 12/2017 | Johnson | A41D 13/001 |
| 2018/0271193 | A1 * | 9/2018 | Aitch | A41D 13/0015 |
| 2018/0343934 | A1 * | 12/2018 | Riley | A41D 3/04 |
| 2019/0298041 | A1 * | 10/2019 | Villaruz | A45F 4/00 |

* cited by examiner

WEARABLE RAIN COVER SYSTEM AND METHOD OF USE

BACKGROUND

1. Field of the Invention

The present invention relates generally to wearable rain protection systems, and more specifically, to a wearable rain cover system for protecting a user's torso and a backpack from rain.

2. Description of Related Art

Rain cover systems such as umbrellas and rain jackets are well known in the art and are effective means to repel rain. It is common for a user to wear a rain jacket to protect their torso from becoming wet, however, there are several disadvantages associated with conventional rain jackets. For example, if a user is carrying a backpack, as is common in outdoor activities as well as on educational campuses, the user has no way of also protecting their backpack and its contents from rain. If the user also has an umbrella, it is still difficult to fully protect both the user's body and backpack from rain as the rain will likely fall at an angle, thereby causing the user or their belongings to become wet. In addition, in the even that a user is hiking or participating in an outdoor activity, carrying both a rain jacket and umbrella is cumbersome.

Accordingly, although great strides have been made in the area of wearable rain protection systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
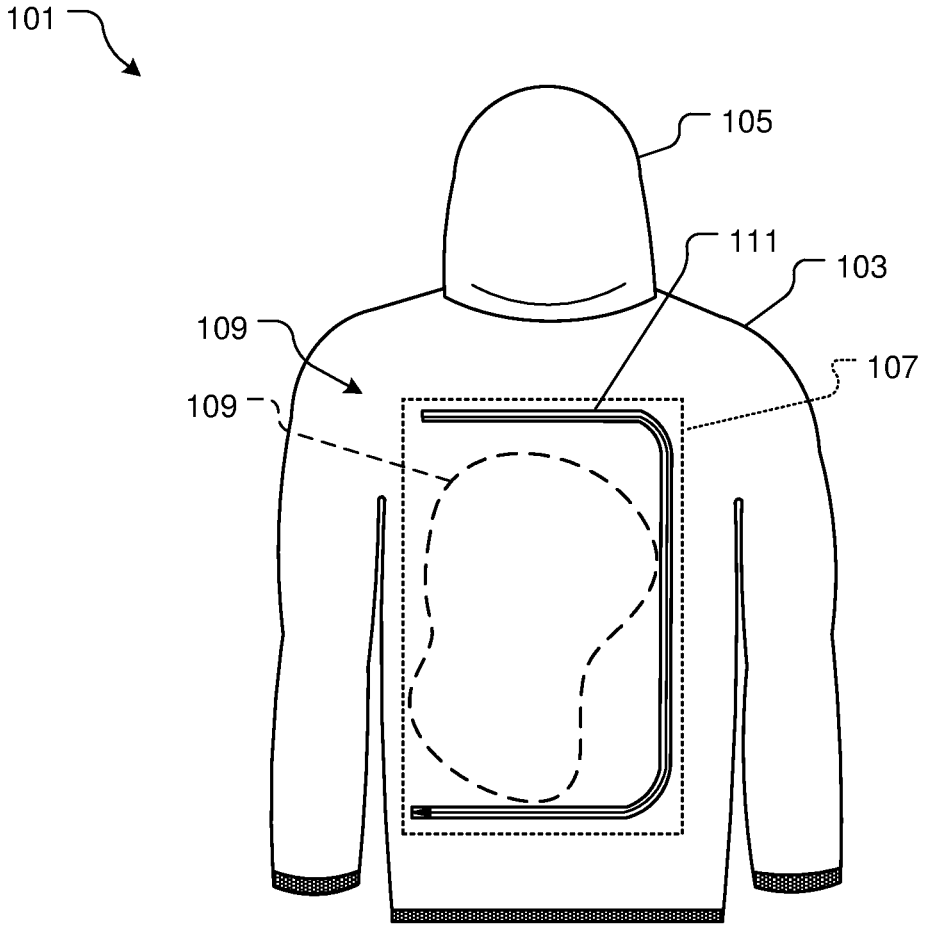
FIG. 1 is a simplified back view of a wearable rain protection system in accordance with a first embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional wearable rain protection systems. Specifically, the present invention provides a means to completely cover both a user's torso and a backpack carried by the user. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a back view of a wearable rain protection system 101 in accordance with a first embodiment of the present application. It will be appreciated that system 101 overcomes one or more of the above-listed problems commonly associated with conventional wearable rain protection systems.

In the contemplated embodiment, system 101 includes a jacket 103 with a hood 105 and a compartment 107 integral with a back 109 of the jacket 103. Compartment 107 houses a pack cover 109 and is accessible via one or more closures 111. In the preferred embodiment, closure 111 is a zipper, however it should be appreciated that other means contemplated include hook and loop fasteners and/or clasps. It should be understood that when in a closed position, pack cover 109 lies substantially flat with the user's back, thereby creating a minimal visual appearance.

Figure 2:
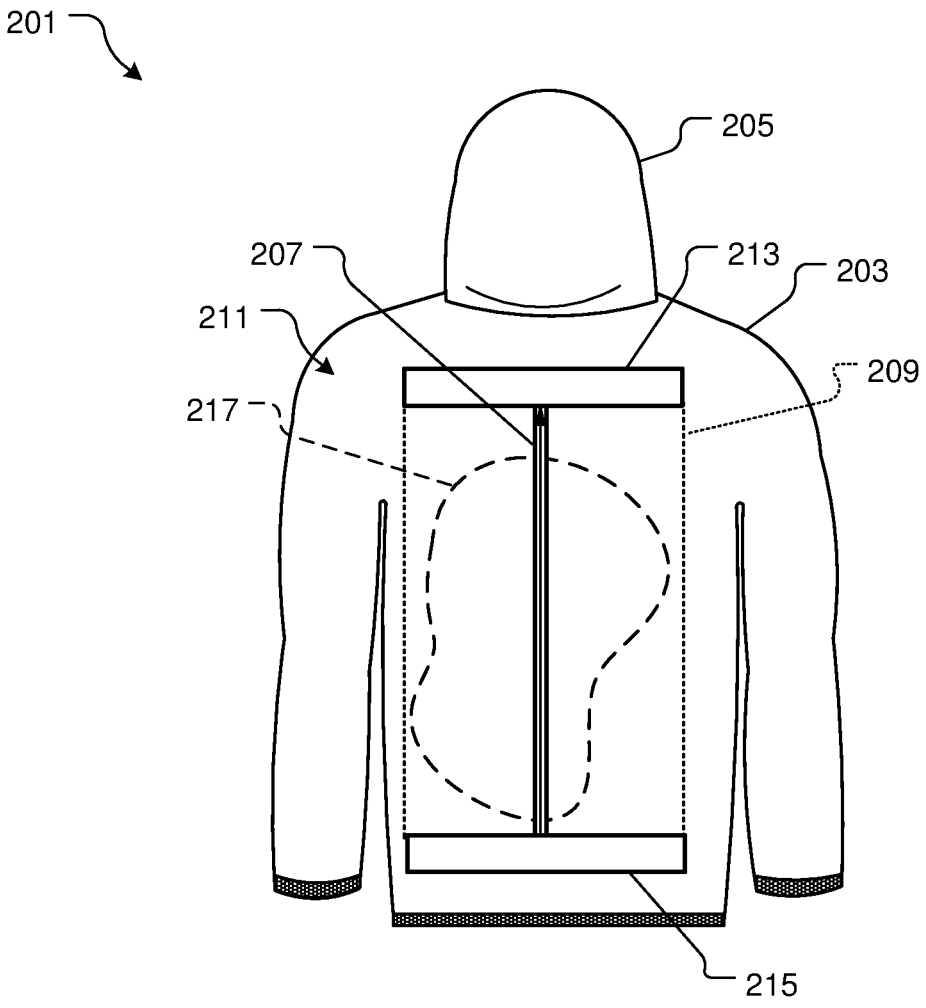
FIG. 2 is a back view of a wearable rain protection system in accordance with a second embodiment of the present application.

In FIG. 2, a second embodiment of a wearable rain protection system 201 is shown, being similar in form and function to system 101. System 201 includes a jacket 203 with a hood 205 and a closure 207 configured to provide access to an interior compartment 209. In this embodiment, closure 207 is a single zipper extending substantially the length of a back 211 of jacket 203. System 201 can further include a top flap 213 and a bottom flap 215 configured to provide further protection from rain. A pack cover 217 is folded within compartment 209 when not in use and configured to extend away from back 211 when used to cover a backpack (shown in FIG. 4).

It should be appreciated that one of the unique features believed characteristic of the present application is the use of a compartment integral with the back of a jacket to hold a pack cover substantially flat against a user's back when not in use. It should be appreciated that this feature provides a means to have a cover extend away from a rain jacket to cover a backpack. This feature allows for a backpack to be completely covered, without any holes or access points in the cover for water to get through.

Figure 3:
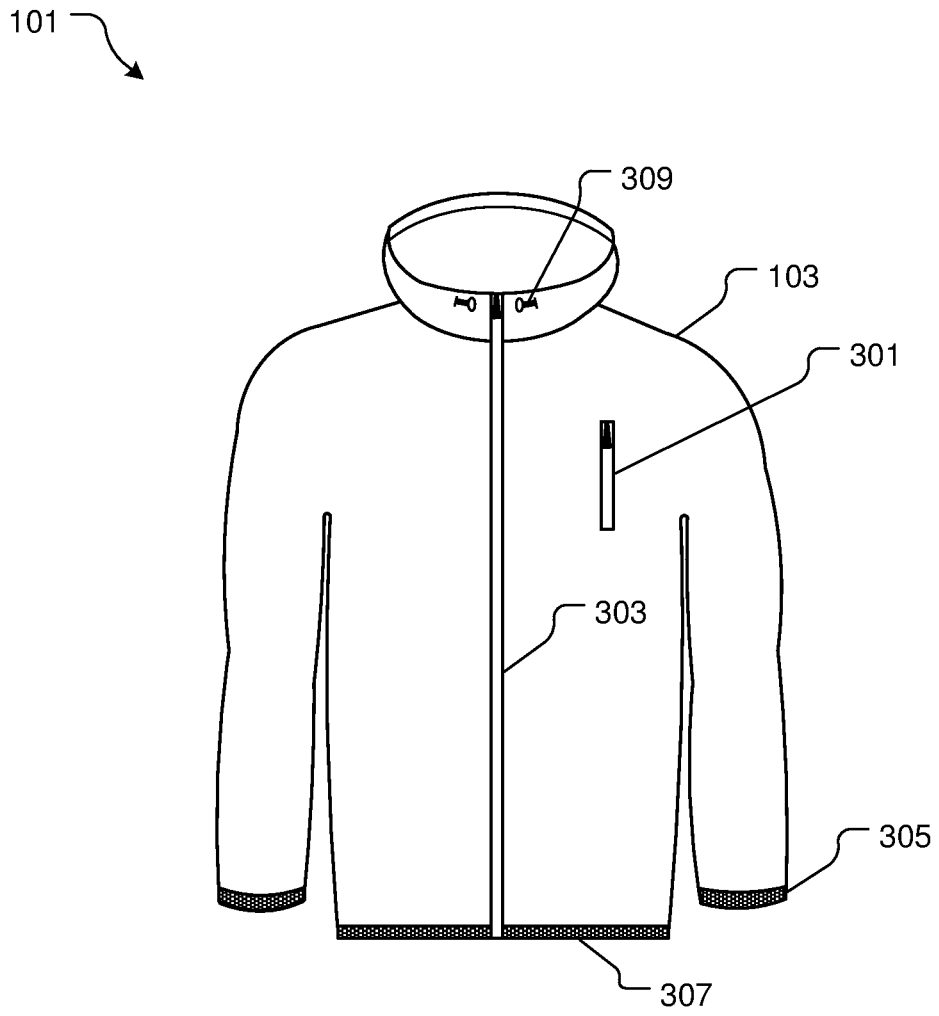
FIG. 3 is a front view of the system of both FIG. 1 and FIG. 2.

In FIG. 3 a front view of system 101 is shown. It should be appreciated that the front view of system 201 is substantially similar to system 101. Jacket 103 can include one or more zipper pockets 301 and a closure 303, such as a zipper. In the preferred embodiment, jacket 103 includes scrunched wristbands 305 configured to prevent water from accessing the user's arms. Similarly, a scrunched waistband 307 and a draw string closure 309 can be included to further prevent water from accessing the torso of the wearer. Jacket 103, as well as the pack cover, are composed of a water repelling material, such as nylon. It should be appreciated that the jacket and cover can vary in size and aesthetical features.

Figure 4:
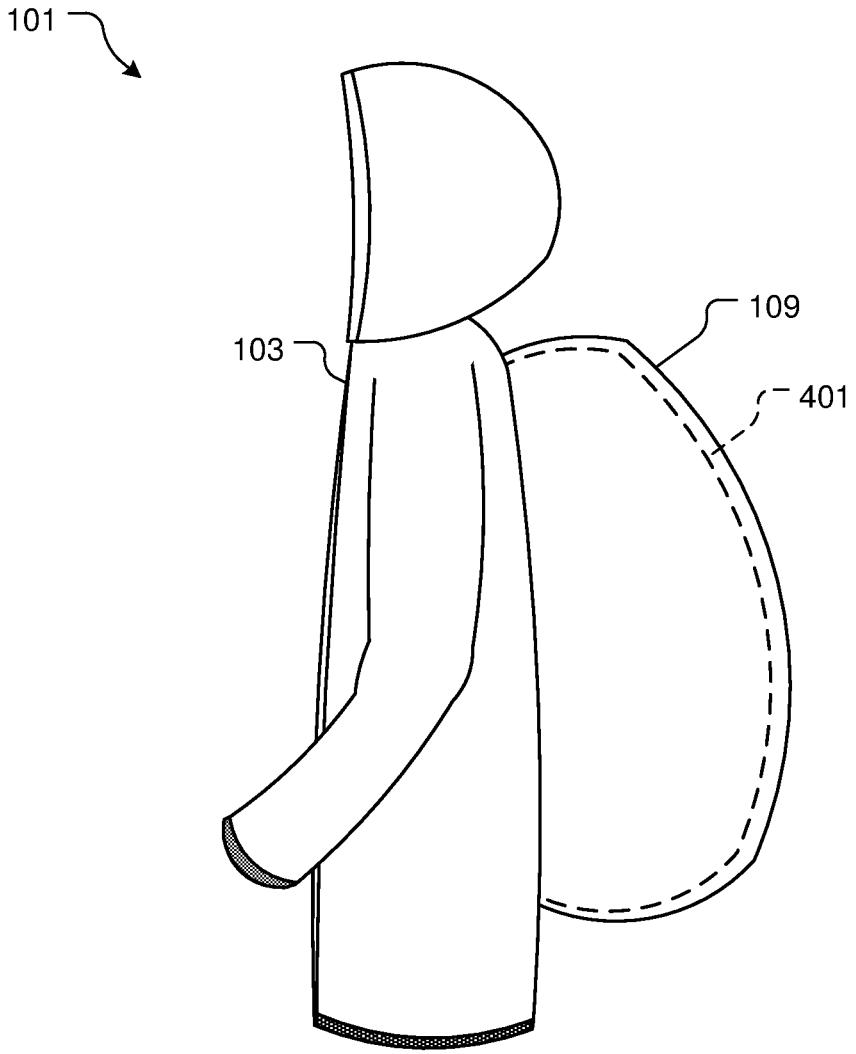
FIG. 4 is a side view of the system of both FIG. 1 and FIG. 2.

In FIG. 4, a side view of system 101 is shown to demonstrate the use of pack cover 109. It should be appreciated that the side view of system 201 is substantially similar to system 101. Pack cover 109 is configured to extend away from the user's back and encompass a backpack 401. It should be understood that the size of cover 109 can vary, however two specifically contemplated sizes are a first size appropriate for covering a standard 70 L backpack and a second size appropriate for covering a standard 20 L backpack.

Figure 5:
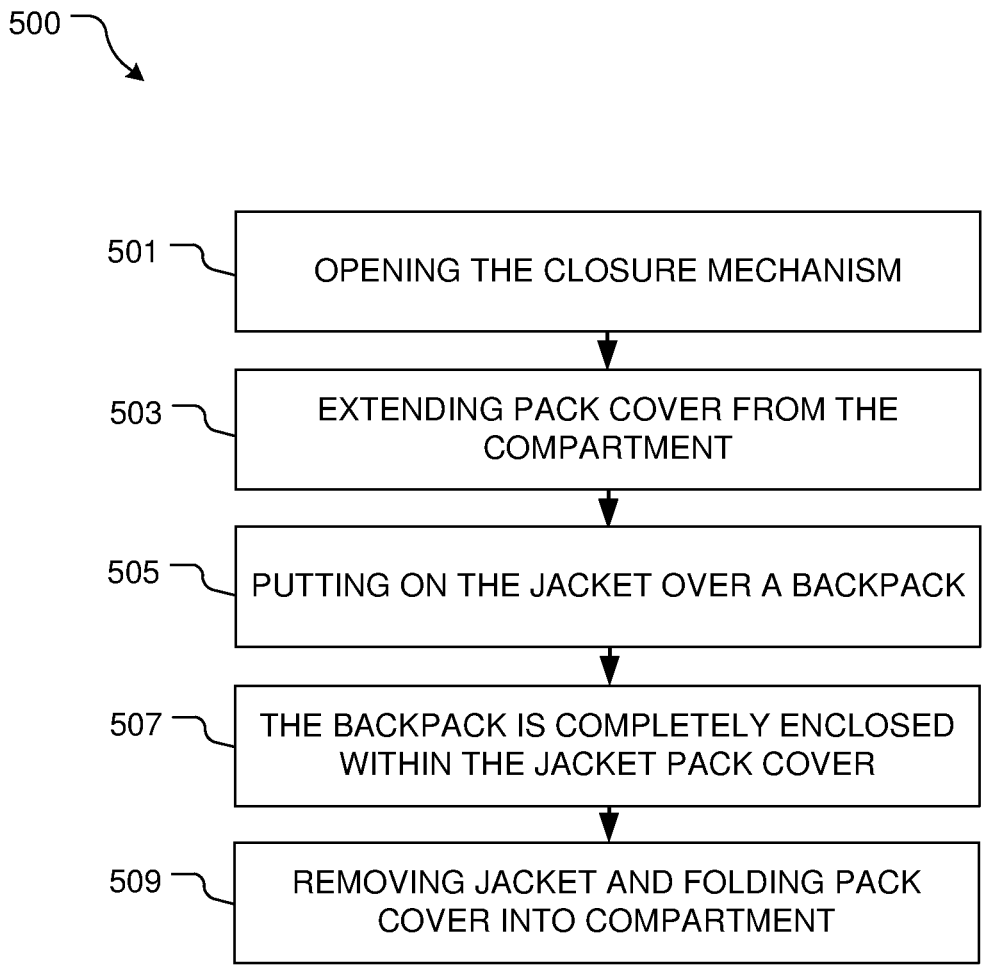
FIG. 5 is a flowchart of the method of use of the system of both FIG. 1 and FIG. 2.

In FIG. 5, a flowchart 500 depicts a method associated with system 101 and 201. During use, the user can wear the system as a jacket until the weather begins to rain. The closure is opened to reveal the pack cover secured within the compartment, as shown with box 501. The pack cover is extended out of the compartment, while remaining attached within the compartment, thereby forming one integral apparatus configured to be worn as a rain jacket and a pack cover, as shown with box 503. The jacket is put on over a backpack being worn by the user, as shown with box 505. The backpack is thereby completely enclosed underneath the cover, without any access points for water to reach the backpack, as shown with box 507. When the rain stops, the user can remove the system and fold the cover back up to be stored within the compartment flat against the user's back, as shown with box 509.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A rain cover system, comprising:

a jacket composed of a rain resistant material configured to be worn by a user, the jacket having:

a back portion having:

a thickness; and a back surface having an elongated length extending from a top to a bottom of the back surface of the back portion;

a compartment disposed within the thickness;

an opening extending the elongated length and configured to provide access to the compartment;

a closure mechanism extending the elongated length and configured to open and close the opening;

a top flap positioned at a top section of the closure and a bottom flap positioned at a bottom section of the closure; and a pack cover disposed within the compartment and configured to extend away from the back portion of the jacket;

wherein the pack cover is configured to enclose a backpack to protect against rain;

wherein the pack cover is integral with the jacket, thereby providing zero access points for water to reach the backpack; and wherein the pack cover is stored flat against a user's back within the compartment when not in use.

2. The rain cover system of claim 1, wherein the jacket further comprises:

a scrunched waistband configured to prevent rain from reaching the user;

two scrunched wristbands configured to prevent rain from reaching the user; and a hood configured to protect a user's head from rain.

3. The rain cover system of claim 1, wherein the closure mechanism is a zipper.

4. The rain cover system of claim 1, wherein the pack cover is sized to cover a backpack.

5. The rain cover system of claim 1, wherein the pack cover is sized to cover a 20 L backpack.

6. The rain cover system of claim 1, wherein the pack cover is composed of nylon.

7. A method of protecting a backpack from rain, the method comprising:

providing the system of claim 1;

opening the closure mechanism when it begins to rain or rain is predicted; extending out the pack cover from the compartment; and putting on the jacket over the backpack, thereby positioning the backpack within the compartment;

wherein the backpack is completely enclosed within the compartment and the jacket; and wherein the user and the backpack are adequately protected from rain via the system of claim 1.

8. The method of claim 7, further comprising:

removing the jacket from the user;

folding up the pack cover into the compartment; and closing the closure to secure the pack cover in a substantially flat position against the user's back.

* * * * *